US009887492B2

(12) United States Patent
Umehara

(10) Patent No.: US 9,887,492 B2
(45) Date of Patent: Feb. 6, 2018

(54) ELECTRICAL CONNECTOR WITH ELASTIC MEMBER

(71) Applicant: Hideaki Umehara, Kanagawa (JP)

(72) Inventor: Hideaki Umehara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 3 days.

(21) Appl. No.: 15/264,092

(22) Filed: Sep. 13, 2016

(65) Prior Publication Data

US 2016/0380384 A1 Dec. 29, 2016

(30) Foreign Application Priority Data

Mar. 17, 2014 (JP) ..... 2014-053324
Jan. 19, 2015 (JP) ..... 2015-007452

(51) Int. Cl.
*H01R 13/631* (2006.01)
*H01R 24/58* (2011.01)
(Continued)

(52) U.S. Cl.
CPC ..... *H01R 13/631* (2013.01); *H01R 13/4538* (2013.01); *H01R 13/5202* (2013.01); *H01R 13/5213* (2013.01); *H01R 24/58* (2013.01)

(58) Field of Classification Search
CPC ..... H01R 13/631; H01R 13/4538; H01R 13/5202; H01R 13/5213; H01R 24/48
(Continued)

(56) References Cited

U.S. PATENT DOCUMENTS 1,901,040 A * 3/1933 Peroni ..... H01R 24/58 200/51.09
5,122,070 A * 6/1992 Lebris ..... G01R 1/07314 324/754.14
(Continued)

FOREIGN PATENT DOCUMENTS

JP S59-094449 U 6/1984
JP H09-283205 10/1997
(Continued)

OTHER PUBLICATIONS

Extended European Search Report dated Dec. 14, 2016 in Patent Application No. 15764752.0.
(Continued)

*Primary Examiner* — Harshad C Patel
(74) *Attorney, Agent, or Firm* — Oblon, McClelland, Maier & Neustadt, L.L.P.

(57) ABSTRACT

A connector includes a housing having a guide part to which a male terminal is inserted, a connection part exposed on the guide part so as to make contact with a terminal member of the male terminal in a state where the male terminal is inserted, a cover member provided on the guide part so as to cover the connection part, while making contact with the connection part, in a state where the male terminal is not inserted, and a spring configured to urge the cover member toward an opening of the guide part in the state where the male terminal is not inserted. The cover member is moved, upon inserting the male terminal, to a side of the guide part opposite to the opening so as not to cover the connection part.

12 Claims, 6 Drawing Sheets

(51) Int. Cl.
*H01R 13/453* (2006.01)
*H01R 13/52* (2006.01)

(58) Field of Classification Search
USPC ..... 439/140, 136, 137, 138, 139, 141, 142
See application file for complete search history.

(56) References Cited

U.S. PATENT DOCUMENTS

| | | | | |
|---|---|---|---|---|
| 5,171,158 | A * | 12/1992 | Cairns | H01R 13/523 439/190 |
| 5,484,296 | A * | 1/1996 | Taylor | H01R 13/523 439/140 |
| 6,231,358 | B1 * | 5/2001 | Kerr, Jr. | H01R 24/66 439/140 |
| 6,413,108 | B2 * | 7/2002 | Centofante | H01R 31/06 361/737 |
| 6,733,311 | B2 * | 5/2004 | Kameda | H01R 13/4538 439/140 |
| 6,976,858 | B1 * | 12/2005 | Kikuchi | H01R 12/716 439/140 |
| 7,140,891 | B1 * | 11/2006 | Huang | H01R 12/716 439/137 |
| 7,322,858 | B1 * | 1/2008 | Rogers | H01R 24/58 439/668 |
| 7,500,859 | B2 * | 3/2009 | Dubranna | H01R 13/523 439/140 |
| 7,654,835 | B1 * | 2/2010 | Chiang | H01R 13/5213 439/137 |
| 7,766,677 | B2 * | 8/2010 | Chiang | H01R 13/5213 439/140 |
| 9,484,664 | B1 * | 11/2016 | Lindstrom | H01R 13/521 |
| 2004/0147163 | A1 | 7/2004 | Chou | |
| 2004/0229484 | A1 * | 11/2004 | Uchida | H01R 13/4538 439/137 |
| 2005/0070141 | A1 | 3/2005 | Dopf et al. | |
| 2007/0212918 | A1 | 9/2007 | Gruebel et al. | |

FOREIGN PATENT DOCUMENTS

| | | |
|---|---|---|
| JP | 3101337 | 10/2000 |
| JP | 2003-086285 | 3/2003 |
| JP | 2007-334256 | 12/2007 |
| JP | 2011-193392 | 9/2011 |
| JP | 2013-069570 | 4/2013 |
| JP | 2013-251250 | 12/2013 |
| WO | 2013/039089 A1 | 3/2013 |

OTHER PUBLICATIONS

International Search Report dated Apr. 7, 2015 in PCT/JP2015/057568 filed on Mar. 13, 2015 (with English translation).
Written Opinion dated Apr. 7, 2015 in PCT/JP2015/057568 filed on Mar. 13, 2015.

* cited by examiner

ELECTRICAL CONNECTOR WITH ELASTIC MEMBER

CROSS-REFERENCE TO RELATED APPLICATIONS

The present application is a continuation application of International Application No. PCT/JP2015/057568, filed Mar. 13, 2015, which claims priorities to Japanese Patent Application No. 2014-053324, filed Mar. 17, 2014, and Japanese Patent Application No. 2015-007452, filed Jan. 19, 2015. The contents of these applications are incorporated herein by reference in their entirety.

BACKGROUND OF THE INVENTION

1. Field of the Invention

The present invention relates to connectors and electronic apparatuses provided with the connectors.

2. Description of the Related Art

An electronic apparatus including an image capturing apparatus such as a digital camera, a portable electronic device such as a cellphone, a smartphone, and a tablet, an image forming apparatus such as a printer, an image projecting apparatus such as a projector, and an information processing apparatus such as a personal computer may be provided with a connector (i.e. jack, female terminal) having a terminal for transmitting and receiving signals to and from an external device and for providing a power supply from an external power source.

An electronic apparatus may be provided with a connector that corresponds to, for example, a 6.3 millimeter (mm) standard phone plug, a 3.5 mm mini plug, a 2.5 mm micro plug, a universal serial bus (USB) plug, etc.

Such a connector provided on an electronic apparatus is connected when a terminal member of a corresponding connector (i.e. plug, male terminal) makes contact with a part having an exposed conductive wire (referred to as a connection part) inside the connecter provided on the electronic apparatus.

Here, it is preferable that such a connecter provided on an electronic apparatus has a waterproof configuration. For example, Japanese Unexamined Patent Application Publication No. 2007-334256 discloses a camera including a terminal for electronically connecting to an external device and a terminal cover, configured to be detachable from the camera, which covers the terminal when the terminal is not in use in order to protect the terminal.

Furthermore, for example, Japanese Unexamined Patent Application Publication No. 2013-69570 discloses, relating to a jack provided on an electronic apparatus such as a cellphone and a smartphone, a waterproof configuration which prevents the possibility that water entered into a plug-insertion hole through a plug-insertion opening enter into the electronic apparatus through another part of the jack.

SUMMARY OF THE INVENTION

To achieve the objective, a connector according to the present embodiment includes a housing having a guide part to which a male terminal is inserted, a connection part exposed on the guide part so as to make contact with a terminal member of the male terminal in a state where the male terminal is inserted, a cover member provided on the guide part so as to cover the connection part, while making contact with the connection part, in a state where the male terminal is not inserted, and an elastic member configured to urge the cover member toward an opening of the guide part in the state where the male terminal is not inserted. The cover member is moved, upon inserting the male terminal, to a side of the guide part opposite to the opening so as not to cover the connection part.

DESCRIPTION OF THE EMBODIMENTS

Figure 1:
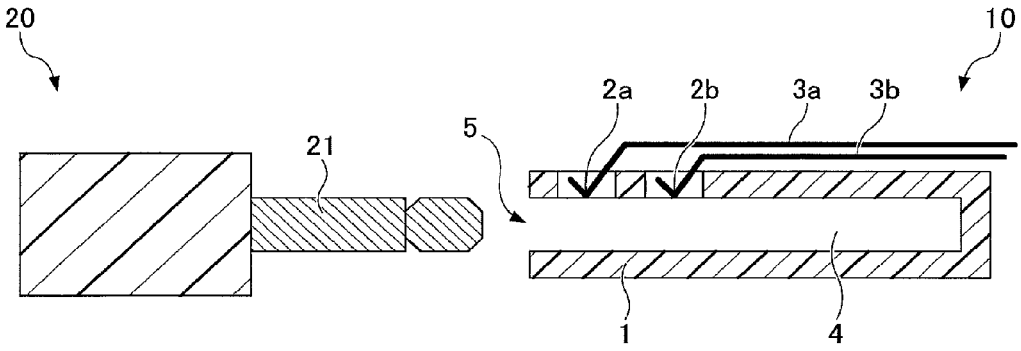
FIG. 1 is a cross-sectional view illustrating a basic configuration of a connector, in a state where a male terminal is not inserted to a guide part which accommodates a terminal inside the connector, according to a first embodiment.

A connection part having an exposed conductive wire inside a connector of an electronic apparatus is particularly preferred to be waterproof because entering of liquid such as water from the outside may cause problems such as a short.

The objective of the present invention is to provide a connector having a property of preventing entering of liquid into a connection part inside the connector.

In the following, configurations of the present invention will be described in detail along with embodiments with reference to FIG. 1 through FIG. 9B.

[First Embodiment]

A connector (connector 10) according to the first embodiment includes a housing (housing 1) having a guide part (guide part 4) to which a male terminal (male terminal 20) is inserted, a connection part (connection part 2*a*, 2*b*) exposed on the guide part so as to make contact with a terminal member (terminal member 21) of the male terminal in a state where the male terminal is inserted, a cover member (cover member 6) provided on the guide part so as to cover the connection part, while making contact with the connection part, in a state where the male terminal is not inserted, and an elastic member (spring 7) configured to urge the cover member toward an opening (opening 5) of the guide part in the state where the male terminal is not inserted. The cover member is moved, upon inserting the male terminal, to a side of the guide part opposite to the opening so as not to cover the connection part. Here, examples of application along with reference signs in the embodiment are noted in brackets.

The connector 10 according to the first embodiment will be described, taking a mini jack which connects to a mini plug as an example. First, with reference to FIG. 1, basic configurations of the connector 10 which is a female terminal and the male terminal (plug) 20 will be described.

FIG. 1 is a cross-sectional view illustrating the basic configuration of the connector 10 according to the first embodiment, in a state where the male terminal 20 is not inserted to a guide part 4 which accommodates a terminal inside the connector 10.

The housing 1, which is an external part of the connector 10 illustrated in FIG. 1, forms the guide part 4 to which the male terminal 20 is inserted. The guide part 4 is provided with connection parts 2 (2*a* and 2*b*), where conductive wires 3 (3*a* and 3*b*) are exposed so as to be connected by an electronic apparatus.

A terminal member 21 of the male terminal 20 to be connected to the connector 10 is inserted to the guide part 4 through an opening 5 of the guide part 4, so that the terminal member 21 makes contact with the connection parts 2 inside the connector 10 for electric conduction.

As the connection parts 2 of the connector 10 illustrated in FIG. 1 are not waterproof, liquid may enter into the guide part 4 in the state where the male terminal 20 is not inserted, which may cause the connection parts 2 to short and may make the connector 10 or an electronic apparatus having the connector 10 become out of order.

Figure 2:
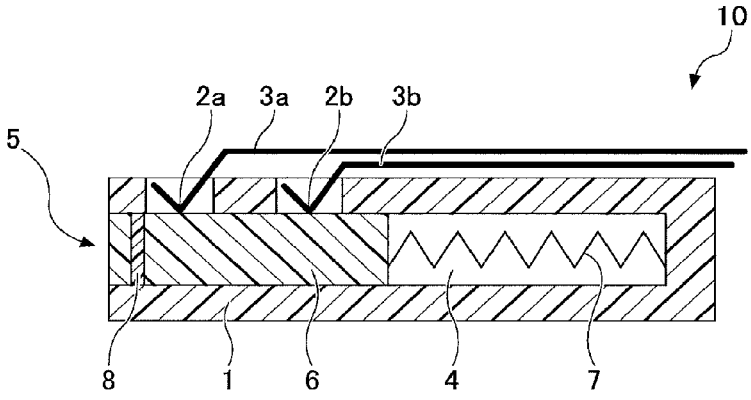
FIG. 2 is a cross-sectional view illustrating the state where the male terminal is not inserted to the guide part of connector 10 according to the first embodiment.

Therefore, the guide part 4 of the connector 10 according to the first embodiment is provided with a slidable cover member 6. FIG. 2 is a cross-sectional view illustrating the connector 10 according to the first embodiment, in the state where the male terminal 20 is not inserted to the guide part 4 which accommodates a terminal inside the connector 10. Further, FIG. 3 is a schematic diagram of the connector 10 illustrated in FIG. 2 viewed from the opening 5.

As illustrated in FIG. 2, the cover member 6 is disposed on a position of the guide part 4 so as to cover at least the connection parts 2*a* and 2*b*. Further, the cover member 6 is supported by a spring 7, which is an elastic member, against the side of the guide part 4 opposite to the opening 5, so that the cover member 6 is urged towards the opening 5 by the spring 7. Here, the elastic member is not limited to the spring 7 as illustrated in the drawing as far as the elastic member urges the cover member 6 towards the opening 5.

Here, it is preferable that, in the state where the male terminal 20 is not inserted, the cover member 6 is positioned so that a surface of the cover member 6 and the external surface of the housing 1 make a flat surface as illustrated in FIG. 2. However, the cover member 6 may be positioned so as to be slightly inside the external surface or partially out of the external surface.

Figure 3:
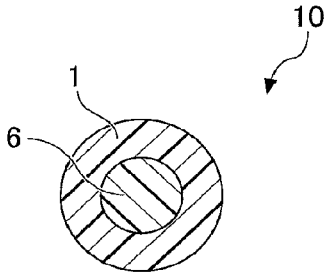
FIG. 3 is a schematic diagram of the connector illustrated in FIG. 2 viewed from an opening, according to the first embodiment.

Further, as illustrated in FIG. 3, it is preferable that the shape of the cross-sectional surface of the cover member 6 has the same type of shape of the cross-sectional surface of the guide part 4 of the connector 10, so that the cover member 6 makes no or small clearance with the internal wall of the guide part 4 in a state where the cover member 6 is set in the guide part 4.

As described above, the cover member 6 of the connector 10 according to the first embodiment covers the opening 5 of the connector 10 and the connection parts 2 exposed on the guide part 4, in the state where the male terminal 20 is not inserted, so as to prevent entering of liquid into the guide part 4 of the connector 10 and a short of the connection parts.

Figure 4:
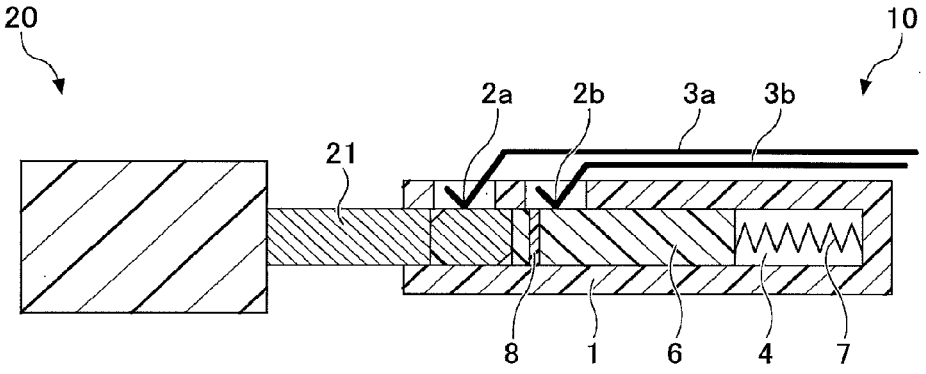
FIG. 4 is a cross-sectional view illustrating a state where the male terminal is partially inserted to the guide part of the connector 10 according to the first embodiment.

FIG. 4 is a cross-sectional view illustrating a state where the male terminal 20 is partially inserted to the guide part 4 of the connector 10. Further, FIG. 5 is a cross-sectional view illustrating a state where the male terminal 20 is inserted to the guide part 4 of the connector 10.

When the terminal member 21 of the male terminal 20 is inserted to the guide part 4 of the connector 10 in the state illustrated in FIG. 2, the cover member 6 is pushed by the terminal member 21 and slid towards the bottom surface of the guide part 4 while the spring 7 is compressed, as illustrated in FIG. 4.

Figure 5:
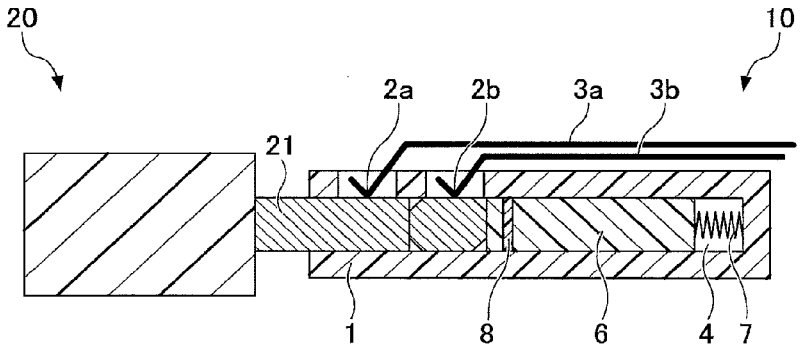
FIG. 5 is a cross-sectional view illustrating a state where the male terminal is inserted to the guide part of the connector according to the first embodiment.

Then, when the terminal member 21 of the male terminal 20 is fully inserted, the cover member is further slid towards the bottom surface as illustrated in FIG. 5, so that the terminal member 21 makes contacts with the connection parts 2*a* and 2*b*. Here, the elastic force of the spring 7 is predetermined not to be so strong that the spring 7 pushes back the male terminal 20 in the state where the male terminal 20 is inserted.

Then, when the male terminal 20 is unplugged, the spring 7 pushes back the cover member 6 towards the opening 5 to return to the state as illustrated in FIG. 2. That is to say, the elastic force of the spring 7 is predetermined not to be so strong that the spring 7 pushes back the male terminal 20 in the state where the male terminal 20 is inserted, but predetermined to be strong enough to push back the cover member 6 in the state where the male terminal 20 is not inserted.

Furthermore, as illustrated in FIG. 2, FIG. 4, and FIG. 5, it is preferable that the cover member 6 is provided with a seal member 8 (such as a packing) so as to seal the gap between the cover member 6 and the internal wall of the guide part 4. The seal member 8 is provided on a position closer to the opening 5 than the positions of the connection parts 2 in the state where the male terminal 20 is not inserted so as to seal the gap between the cover member 6 and the internal wall of the guide part 4.

The slidable cover member 6 of the connector 10 according to the first embodiment as described above covers the connection parts 2 disposed inside the connector 10 in the state where the male terminal 20 is not inserted, and therefore prevents a short of the connection parts 2. Furthermore, as the cover member 6 has the shape that can be set in the guide part 4, entering of liquid into the guide part 4 is prevented. Moreover, the seal member 8 disposed on the cover member 6 further effectively prevents entering of liquid into the connection parts 2, so as to enhance the waterproof effect.

Furthermore, the connector 10 is provided with the slidable cover member 6 disposed inside the housing 1, not provided with an exterior cover, so that the connector 10 can be connected with a male terminal without causing problems such as taking the cover off and putting the cover back on. Here, entering of liquid is securely prevented as a user cannot fail to forget to put the cover on.

Further, an electronic apparatus may be provided with the connector 10 according to the first embodiment so as to be waterproof on the connector part. The connector 10 is applicable to any electronic apparatuses, for example, an image capturing apparatus such as a digital camera, a portable electronic device such as a cellphone, a smartphone, and a tablet, an image forming apparatus such as a printer, an image projecting apparatus such as a projector, and an information processing apparatus such as a personal computer. Particularly, the connector 10 is preferably applied to portable electronic devices with high risk of getting wet such as a digital camera and a cellphone.

[Second Embodiment]

In the following, another embodiment of the connector 10 according to the present invention will be described. Here, elements having the same configurations as in the embodiment above are appropriately omitted.

In the above description of the first embodiment, the elastic force of the spring 7 is predetermined not to be so strong that the spring 7 pushes back the male terminal 20 in the state where the male terminal 20 is inserted to the connector 10. Here, it is preferable that the connector 10 is provided with a structure (i.e. urging stopper) which prevents the spring 7 from pushing back the terminal member 21 and the cover member 6 in the state where the terminal member 21 of the male terminal 20 is fully inserted.

An urging stopper according to the second embodiment includes a pin member (lock pin 35) provided on the cover member 6, and a lever member (lock lever 30) provided on the housing 1. The pin member and the lever member stick out in the guide part 4 in the state where the male terminal 20 is inserted. The pin member and the lever member make contact with each other on surfaces orthogonal to a direction in which the spring 7 urges the cover member 6 and the terminal member 21 toward the opening 5.

Figure 6A:
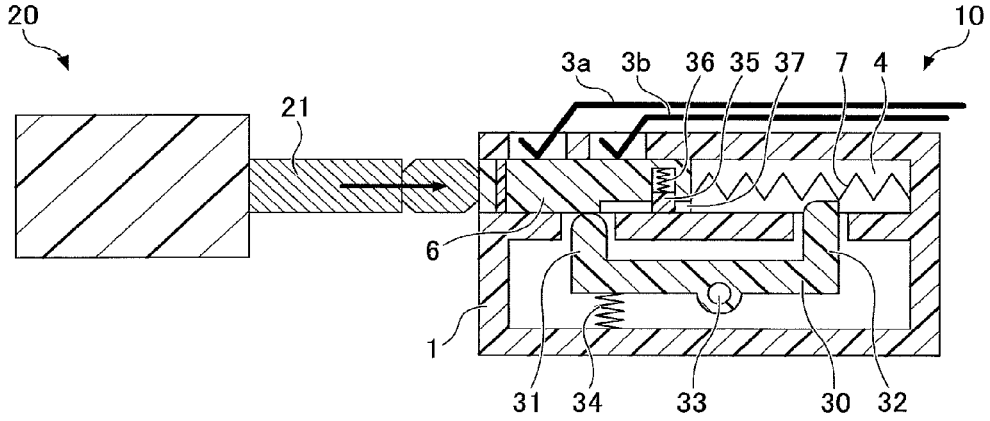
FIG. 6A is a cross-sectional view illustrating a state where the male terminal is about to be inserted to the guide part of the connector according to a second embodiment.

The connector 10 provided with the urging stopper will be described, with reference to FIGS. 6A through 6C and FIG. 7. FIG. 6A is a cross-sectional view illustrating a state where the terminal member 21 of the male terminal 20 is about to be inserted to the guide part 4 of the connector 10.

As illustrated in FIG. 6A, a U-shaped lock lever 30, supported by a fulcrum point 33 so as to be swayable, is provided on a lower portion of the housing 1 of the connector 10. A projecting part 31 of the lock lever 30 near the opening 5 is urged by a spring 34, so as to make contact with the cover member 6 in the state where the male terminal 20 is not inserted.

A projecting part 32 of the lock lever 30 near the bottom of the guide part 4 has a greater degree of projection compared to the projecting part 31, so that the projection tip sticks out into the guide part 4 in the state where the male terminal 20 is not inserted. Here, as illustrated, the housing 1 has openings so that the projecting parts 31 and 32 may stick out into the guide part 4 in accordance with sway of the lock lever 30.

Furthermore, a lock pin 35 and a spring 36 which urges the lock pin 35 are provided on the cover member 6 near the end supported by the spring 7. Moreover, a notch 37 is formed on the cover member 6, so as to guide the projection tip of the projecting part 32.

Figure 6B:
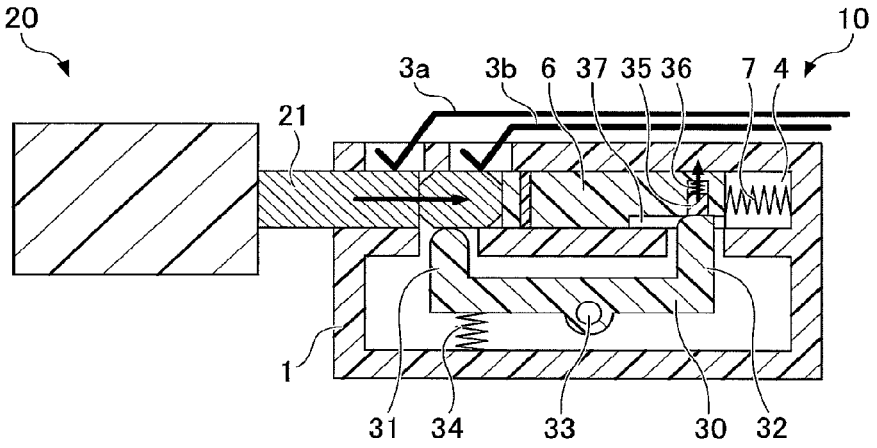
FIG. 6B is a cross-sectional view illustrating a state where the male terminal is partially inserted to the guide part of the connector according to the second embodiment.

FIG. 6B is a cross-sectional view illustrating the state where the terminal member 21 of the male terminal 20 is partially inserted to the guide part 4 of the connecter 10. Further, the FIG. 6C is a cross-sectional view illustrating the state where the terminal member 21 of the male terminal 20 is fully inserted to the guide part 4 of the connecter 10.

As illustrated in FIG. 6B, when the cover member 6 is pushed in by the terminal member 21 of the male terminal 20, the projecting part 32 is guided by the notch 37 formed on the cover member 6. Then, the lock pin 35 provided on the cover member 6 is positioned on top of the projecting part 32 of the lock lever 30 while the spring 36 is compressed. Here, it is preferable that the projecting part 32 has an R-shape on the side facing the opening 5, so that the lock pin 35 easily gets on top of the projecting part 32 when the terminal member 21 is inserted. Here, the projecting part 32 has a flat shape on the side facing the bottom of the guide part 4.

Figure 6C:
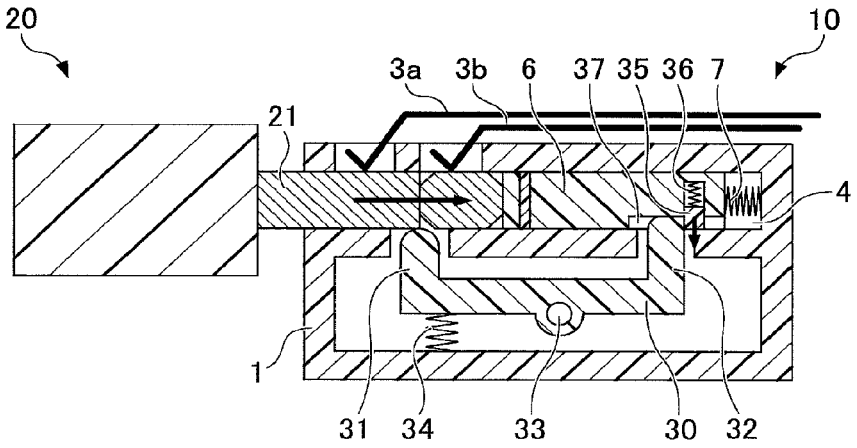
FIG. 6C is a cross-sectional view illustrating a state where the male terminal is fully inserted to the guide part of the connector according to the second embodiment.

Then, when the cover member 6 is further pushed in by the terminal member 21 of the male terminal 20 and the lock pin 35 gets over the projecting part 32, the lock pin 35 is pushed by the spring 36 so as to stick back out into the notch 37 on a position beyond the projecting part 32 as illustrated in FIG. 6C.

In the state described above, the surface of the lock pin 35 facing the opening 5 and the surface of the projecting part 32 facing the bottom of the guide part 4 are engaged. Here, the force of the spring 7 pushing the cover member 6 is restrained as the surface of the lock pin 35 facing the opening and the surface of the projecting part 32 facing the bottom of the guide part 4 touch each other. Therefore, it is prevented that the cover member 6 is pushed back toward the opening 5 and that the terminal member 21 of the male terminal 20 is pushed back when the terminal member 21 of the male terminal 20 is inserted.

Figure 7:
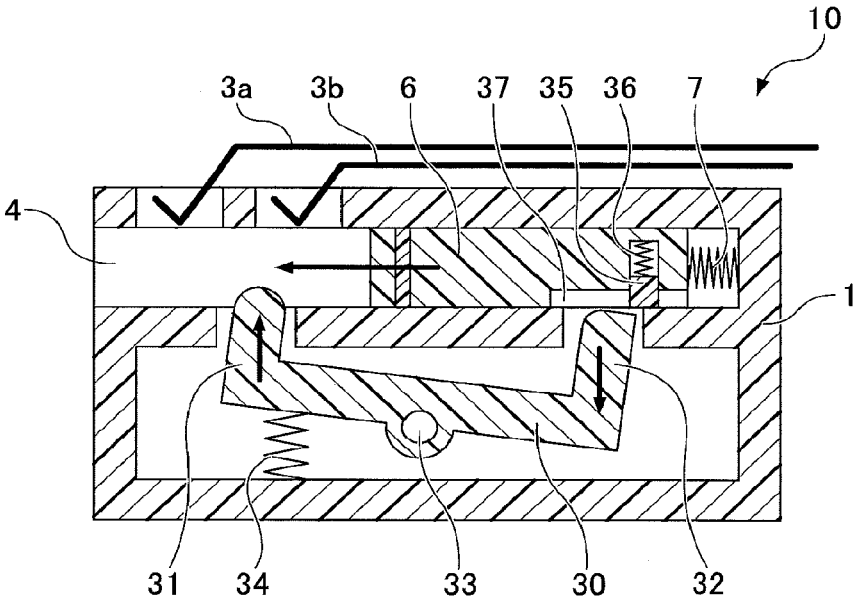
FIG. 7 is a cross-sectional view illustrating a state where, after the male terminal is inserted, the male terminal is unplugged from the guide part of the connector according to the second embodiment.

FIG. 7 is a cross-sectional view illustrating a state where, after the male terminal 20 is inserted, the terminal member 21 of the male terminal 20 is unplugged from the connector 10. When the terminal member 21 of the male terminal 20 is unplugged from the connector 10, there is neither the cover member 6 nor the terminal member 21 on the position opposed by the projecting part 31 of the lock lever 30, and therefore the lock lever 30 is swayed by the urging force of the spring 34 so that the projecting part 31 sticks out into the guide part 4.

Here, the engagement of the lock pin 35 and the projecting part 32 is released as the projecting part 32 of the lock lever 30 moves downward, and therefore the cover member 6 is pushed back by the urging force of the spring 7 to the original position as illustrated in FIG. 6A.

The connector 10 provided with such an urging stopper as described above can prevent the male terminal 20 from unintentionally being unplugged. Furthermore, adjusting and selecting the spring 7 is easy here because greater elastic force of the spring 7 may be applied. Here, the urging stopper as illustrated in FIGS. 6A through 6C and FIG. 7 is just an example and the urging stopper is not limited to the example as far as the urging stopper has a configuration for preventing the male terminal 20 from being pushed back by the cover member 6 in the state where the male terminal 20 is inserted.

[Third Embodiment]

In the following, another embodiment of the connector 10 according to the present invention will be described. Here, elements having the same configurations as in the embodiments above are appropriately omitted.

The housing 1 of the connector 10 according to the third embodiment is provided with a seal member 9 on the internal wall of the guide part 4 so as to seal the gap between the terminal member 21 of the male terminal 20 inserted to the guide part 4 and the internal wall of the guide part 4. The seal member 9 prevents, in the state where the male terminal 20 is inserted to the connector 10, entering of liquid such as water through the gap between the terminal member 21 of the inserted male terminal 20 and the internal wall of the guide part 4 of the connector 10 and prevents a short of the connection parts 2.

Figure 8:
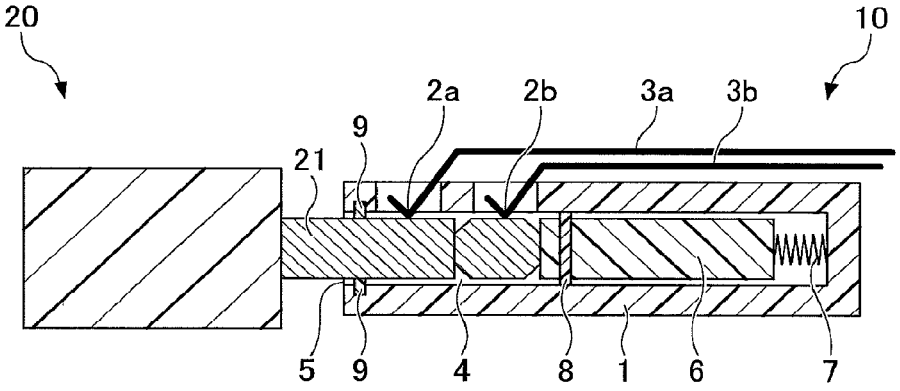
FIG. 8 is a cross-sectional view illustrating an example of the connector according to a third embodiment.

FIG. 8 is a cross-sectional view illustrating an example of the connector 10 according to the third embodiment.

As illustrated in FIG. 8, the housing 1 of the connector 10 is provided with the seal member 9 on the internal wall of the guide part 4 on a position closer to the opening 5 than the positions of the connection parts 2*a* and 2*b*. The seal member 9 seals the gap between the internal wall of the guide part 4 and the external surface of the male terminal 20 in the state where the male terminal 20 is inserted to the connector 10.

The seal member 9 provides a secure waterproof property in the state where the male terminal 20 is inserted to the guide part 4 of the connector 10, so as to prevent problems that occur due to entering of liquid into the connector 10, such as a short.

The seal member 9 of the connector 10 according to the third embodiment as described above seals the gap between the terminal member 21 of the male terminal 20 and the internal wall of the guide part 4, so as to improve the waterproof property of the connector 10 in the state where the male terminal 20 is inserted.

Here, the connector 10 may be provided with both the seal member 8 on the cover member 6 and the seal member 9 on the housing 1 as illustrated in the drawing relating to the third embodiment, but may also be provided with either one of the seal member 8 or the seal member 9. The seal member 8 provided on the cover member 6 improves the waterproof property in the state where the male terminal 20 is not inserted. The seal member 9 provided on the housing 1 improves the waterproof property not only in the state where the male terminal 20 is not inserted but also in the state where the male terminal 20 is inserted. Providing both the seal member 8 and the seal member 9 further improves the waterproof property of the connector 10 and prevents entering of liquid into the guide part 4 more securely in the states where the male terminal 20 is and is not inserted.

[Fourth Embodiment]

In the following, another embodiment of the connector 10 according to the present invention will be described. Here, elements having the same configurations as in the embodiments above are appropriately omitted.

Figure 9A:
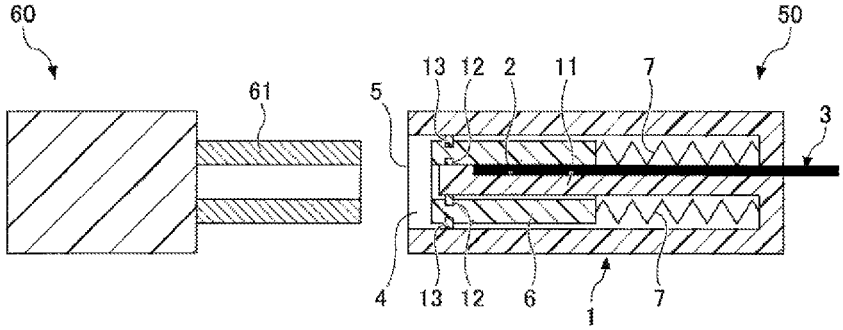
FIG. 9A is a cross-sectional view illustrating a connector according to a fourth embodiment, in a state where a male terminal is not inserted.
Figure 9B:
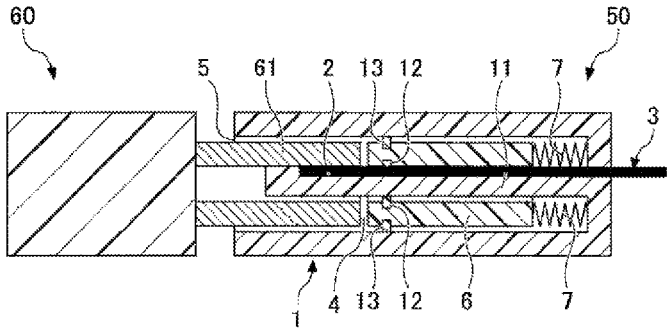
FIG. 9B is a cross-sectional view illustrating the connector according to the fourth embodiment, in a state where the male terminal is inserted.

FIG. 9A is a cross-sectional view illustrating a connector 50 according to the fourth embodiment, in a state where a male terminal 60 is not inserted. FIG. 9B is a cross-sectional view illustrating the connector 50 according to the fourth embodiment, in a state where the male terminal 60 is inserted.

As illustrated in FIGS. 9A and 9B, the connector 50 according to the fourth embodiment is provided with the housing 1 having a shape of a hollow quadrangular prism, the conductive wire 3, the cover member 6, and the spring 7. A terminal member 61 of the male terminal 60 such as a USB is inserted to the connector 50.

The housing 1 forms the guide part 4 to which the terminal member 61 of the male terminal 60 is inserted, the opening 5 of the guide part 4, and a prominent part 11 in a shape of a flat plate which sticks out from the side of the guide part 4 opposite to the opening 5 toward the opening 5.

The conductive wire 3 is disposed along the prominent part 11 on the guide part of the connector 50, so that the connection parts 2, with which the terminal member 61 of the male terminal 60 makes contact, is provided on the surface of the prominent part 11.

The cover member 6, having a cross-sectional shape which is set in the guide part 4, is disposed on the guide part 4 so as to be slidable along the prominent part 11 in a way of sliding the circumference of the prominent part 11 or the sides of the prominent part 11. The cover member 6 is urged by the spring 7, which is provided on the end of the guide part 4 opposite to the opening 5, toward the opening 5. The cover member 6 is urged by the spring 7 so that, in the state where the male terminal 60 is not inserted, the end the cover member 6 facing the opening 5 is on a position closer to the opening 5 than the position of the connection part 2.

The cover member 6 is provided with a seal member 12 on a position closer to the opening 5 than the position of the connection part 2 in the state where the male terminal 60 is not inserted, so as to seal the gap with the prominent part 11. The seal member 12 seals the gap between the internal surface of the cover member 6 and the external surface of the prominent part 11 formed by the housing 1, so as to prevent entering of liquid into the connection part 2 in the state where the male terminal 60 is not inserted.

Furthermore, the cover member 6 is provided with a seal member 13 on the external surface, so as to seal the gap between the external surface of the cover member 6 and the internal surface of the guide part 4. The seal member 13 prevents entering of liquid into the housing 1 through the gap between the external surface of the cover member 6 and the internal surface of the guide part 4.

As illustrated in FIG. 9A, in the state where the male terminal 60 is not inserted to the connector 50, the cover member 6 is pushed by the spring 7 and positioned close to the opening 5. In the state described above, the seal member 12 provided on the internal surface of the cover member 6 seals the gap between the internal surface of the cover member 6 and the external surface of the prominent part 11 formed by the housing 1. Similarly, the seal member 13 seals the gap between the external surface of the cover member 6 and the internal surface of the guide part 4. Here, the seal members 12 and 13 prevent entering of liquid into the connection part 2.

As described in FIG. 9B, in the state where the male terminal 60 is inserted to the connector 50, the cover member 6 is pushed by the terminal member 61 of the male terminal 60 and positioned on the side of the guide part 4 opposite to the opening 5 while the spring 7 is compressed. In the state where the cover member 6 is pushed toward the side of the guide part 4 opposite to the opening 5, the connection part 2 is exposed on the guide part 4 out of the cover member 6, so that the connection part 2 and the terminal member 61 of the male terminal 60 make contact with each other.

The seal member 12 of the connector 50 according to the fourth embodiment as described above seals the gap between the internal surface of the cover member 6 and the external surface of the prominent part 11 in the state where the male terminal 60 is inserted to the connector 50. Furthermore, the seal member 13 seals the gap between the external surface of the cover member 6 and the internal surface of the housing 1. According to such a configuration, entering of liquid into the connection part 2 is prevented and the waterproof property is improved.

Here, another seal member may be provided on the internal surface of the guide part 4 formed by the housing 1 of the connector 50 so as to seal the gap between the internal surface of the guide part 4 formed by the housing 1 and the terminal member 61 of the male terminal 60 in the state where the male terminal 60 is inserted. According to such a configuration, entering of liquid into the guide part 4 of the connector 50 is further prevented and the waterproof property is further improved.

Further, the urging stopper exemplified in the second embodiment may be provided on the connector 10 according to the third embodiment or the connector 50 according to the fourth embodiment described above. Such an urging stopper prevents the male terminal 20 or the male terminal 60 inserted to the connector 10 or the connector 50 from unintentionally being unplugged. Here, the urging stopper provided on the connector 10 or the connector 50 is not limited to the example described in the second embodiment, as far as the urging stopper is capable of keeping the spring 7 compressed and keeping the cover member 6 pushed in the guide part 4.

Further, although the embodiments described above are preferable examples for implementation, the present invention is not limited to the above embodiments and various variations may be made without departing from the scope of the present invention.

For example, although a configuration in which the external surface of a male terminal makes contact with connection parts disposed in a connector is described in the first through the third embodiments, taking examples of a mini plug as the male terminal and a mini jack as the connector, the present invention is applicable to a configuration in which the a terminal member is disposed inside a plug such as a USB plug corresponding to a USB connector as illustrated in the fourth embodiment. Further, the standard for terminals to be connected is not specifically limited, and therefore the present invention is duly applicable to connectors with other standards such as a connector for local area network (LAN) cable and a connector for the Institute of Electrical and Electronics Engineers (IEEE) 1394.

Although the connector is described above along with embodiments, the present invention is not limited to the above embodiments and various variations and modifications may be made without departing from the scope of the present invention as claimed.

According to the present invention, a short of a connection part caused by entering of liquid into the connection part inside the connector is prevented.

What is claimed is:

1. A connector comprising:

a male terminal including a terminal member;

a housing including a guide part to which the male terminal is inserted;

a connection part exposed on the guide part so as to make contact with the terminal member of the male terminal in a state where the male terminal is inserted;

a cover member provided on the guide part so as to cover a side contacted with the terminal member of the male terminal of the connection part that is exposed on the guide part, while making contact with the connection part, in a state where the male terminal is not inserted; and an elastic member configured to urge the cover member toward an opening of the guide part in the state where the male terminal is not inserted, wherein the cover member is moved, upon inserting the male terminal, to a side of the guide part opposite to the opening so as not to cover the connection part.

2. The connector according to claim 1, wherein the cover member is formed to be set in the guide part.

3. The connector according to claim 1, wherein the cover member comprises a seal member configured to seal a gap with an internal wall of the guide part, and wherein the seal member is provided on a position closer to the opening than a position of the connection part so as to seal the cover member and the internal wall of the guide part in the state where the male terminal is not inserted.

4. The connector according to claim 1, wherein the cover member is positioned so as to make a flat surface with an external surface of the housing in the state where the male terminal is not inserted.

5. The connector according to claim 1, further comprising an urging stopper configured to prevent the elastic member from urging the cover member toward the opening in the state where the male terminal is inserted.

6. The connector according to claim 5, wherein the urging stopper comprises:

a pin member provided on the cover member, and a lever member provided on the housing, wherein the pin member and the lever member stick out in the guide part in the state where the male terminal is inserted, and wherein the pin member and the lever member make contact with each other on surfaces orthogonal to a direction in which the elastic member urges the cover member toward the opening.

7. The connector according to claim 1, wherein the housing comprises a second seal member provided on a position closer to the opening than the position of the connection part, so as to seal a gap with the male terminal inserted to the g part.

8. The connector according to claim 1, wherein the housing has a prominent part sticking out through the guide part toward the opening, wherein the connection part is provided on a surface of the prominent part, and wherein the cover member comprises:

a third seal member provided on a position closer to the opening than the position of the connection part in the state where the male terminal is not inserted, so to seal a gap with the prominent part, and a fourth seal member provided on an external surface of the cover member, as to seal a gap with an internal surface of the guide part.

9. An electronic apparatus comprising a connector according to claim 1.

10. The connector according to claim 1, wherein the cover member is disposed inside the guide part.

11. The connector according to claim 1, wherein the cover member is disposed inside the guide part on such a position as to cover the connection part in the state where the male terminal is not inserted.

12. The connector according to claim 1, wherein the cover member is disposed inside the guide part in such a shape as to close the opening and cover the connection part in the state where the male terminal is not inserted.

* * * * *